US005163297A

United States Patent [19]

Yani et al.

[11] Patent Number: 5,163,297

[45] Date of Patent: Nov. 17, 1992

[54] DEVICE FOR PREVENTING EVAPORATION OF LIQUEFIED GAS IN A LIQUEFIED GAS RESERVOIR

[75] Inventors: Masayoshi Yani, Sakai; Etsuji Kawaguchi, Otsu; Michio Sugata, Moriyama; Mitsunori Irie, Amagasaki, all of Japan

[73] Assignee: Iwatani international Corporation, Osaka, Japan

[21] Appl. No.: 641,704

[22] Filed: Jan. 15, 1991

[51] Int. Cl.[5] ..... F17C 5/02

[52] U.S. Cl. ..... 62/47.1; 62/51.1; 62/227; 250/352

[58] Field of Search ..... 62/47.1, 51.1, 226, 62/227; 250/352

[56] References Cited

U.S. PATENT DOCUMENTS

| | | | |
|---|---|---|---|
| 3,866,785 | 2/1975 | Conte | 62/47.1 |
| 4,277,949 | 7/1981 | Longsworth | 62/47.1 |
| 4,543,793 | 10/1985 | Chellis et al. | 62/226 |
| 4,543,794 | 10/1985 | Matsutani et al. | 62/47.1 |
| 4,766,741 | 8/1988 | Bartlett et al. | 62/47.1 |
| 4,790,147 | 12/1988 | Kuriyama et al. | 62/47.1 |
| 4,796,433 | 1/1989 | Bartlett | 62/47.1 |
| 4,967,564 | 11/1990 | Strasser | 62/47.1 |

FOREIGN PATENT DOCUMENTS 2-279977 11/1990 Japan .

*Primary Examiner*—Ronald C. Capossela
*Attorney, Agent, or Firm*—Foley & Lardner

[57] ABSTRACT

A device for preventing evaporation of liquefied gas in a liquefied gas reservoir used to cool an EDS detector of an electron microscope or the like is disclosed. A cold head of a cryogenic refrigerator is disposed so as to fit an opening of the top of the liquefied gas reservoir and moreover a temperature measuring instrument or a level gauge is disposed within the liquefied gas reservoir so that the cryogenic refrigerator is automatically operated depending on the temperature within the liquefied gas reservoir or on change in the liquid level of liquefied gas. In the manner vaporized gas is condensed and reliquefied, thus suppressing wasteful dissipation of vaporized gas.

16 Claims, 3 Drawing Sheets

DEVICE FOR PREVENTING EVAPORATION OF LIQUEFIED GAS IN A LIQUEFIED GAS RESERVOIR

BACKGROUND OF THE INVENTION

1. Field of the Invention

The present invention relates to devices for preventing evaporation of liquefied gas in a low-temperature generator using liquefied gas to cool an EDS detector (Energy Dispersive Spectrometer type X-ray detector) that allows electron microscopes to have the element analysis function.

2. Description of the Prior Art

Conventional electron microscopes have such an arrangement that the EDS detector is cooled with liquid nitrogen so as to enhance their measurement accuracy. In such an electron microscope, conventionally, there is provided a cold finger that is coupled with and drawn from the bottom wall of a reservoir in which liquid nitrogen is stored, and an EDS detector is mounted to the cold finger, thereby allowing the EDS detector to be held in a cryogenically low temperature state with the use of liquid nitrogen.

The EDS detector used in such a type of apparatus is required to keep its cooling temperature within a certain range once the detector has been cooled. The liquid nitrogen used to cool the EDS detector, however, is subject to some dissipation out of its reservoir due to evaporation. This compels an operator to frequently refill the liquefied gas reservoir with liquid nitrogen in order to make up for dissipated liquid nitrogen.

Disadvantageously, since an electron microscope incorporating an EDS detector restricts the floor height at which the liquefied gas reservoir for cooling the EDS detector is disposed relative to the irradiation axis thereof, the liquefied gas supply port opening at the upper portion of the reservoir has a height from the floor, for example, as high as 1.5 m. As a result, it would be laborious work for the operator to refill the liquid nitrogen reservoir with liquid nitrogen using a supply vessel such as a Dewar vessel.

The present invention has been accomplished in view of the foregoing problems and therefore it is the primary object of the invention to provide devices for preventing evaporation of liquefied gas in a liquefied gas reservoir which can dispense with the resupply of liquefied gas over a long time period.

SUMMARY OF THE INVENTION

To achieve the above-mentioned object, the present invention provides a device for preventing evaporation of liquefied gas characterized in that, in an electron microscope in which a cold finger is coupled with and drawn from a liquefied gas reservoir and an EDS detector is secured thereto, the arrangement is such that a cold head of a cryogenic refrigerator is disposed so as to fit an opening at the top of the liquefied gas reservoir and is braced to a frame with a linear guide mechanism interposed therebetween, the liquefied gas reservoir is braced to the cold head of the cryogenic refrigerator with vibration preventive means interposed therebetween, and the cold end of the cold head is plunged into the liquefied gas reservoir from the opening at the top thereof so as to allow the temperature within the liquefied gas reservoir to be detected by a temperature measuring instrument. In the manner, the cryogenic refrigerator is controlled for its automatic operation according to the temperature detected by the temperature measuring instrument, whereas the invention provides another device for preventing evaporation of liquefied gas further characterized in that, in addition to the above arrangement, a lead-in passageway for refrigerant gas is disposed so as to communicate with the opening at the top of the liquefied gas reservoir, the gas lead-in passageway having a gas supply control valve interposed therein. The gas supply control valve is controlled for opening and closing and moreover the cryogenic refrigerator is controlled for its automatic operation according to the lower-limit liquid level detection actuation of a level gauge which is adapted to detect the liquefied gas liquid level within the liquefied gas reservoir.

Since a device for preventing evaporation of liquefied gas according to the present invention has such an arrangement that, in a measuring instrument in which a cold finger is coupled with and drawn from a liquefied gas reservoir and a semiconductor sensor is secured thereto, a cold head of a cryogenic refrigerator is disposed so as to fit an opening at the top of the liquefied gas reservoir and is braced to a frame with a linear guide mechanism interposed therebetween, the liquefied gas reservoir is braced to the cold head of the cryogenic refrigerator with vibration preventive means interposed therebetween, and the cold end of the cold head is plunged into the liquefied gas reservoir from the opening at the top thereof so as to allow the temperature within the liquefied gas reservoir to be detected by a temperature measuring instrument. In this manner, the cryogenic refrigerator is controlled for its automatic operation according to the temperature detected by the temperature measuring instrument, vaporized gas within the liquefied gas reservoir is cooled and condensed by the cryogenic refrigerator, thus being reliquefied. Accordingly, vaporized gas is no longer dissipated wastefully so that the cycle of refilling the liquefied gas can be prolonged, the work load of refilling the liquefied gas reservoir with the liquefied gas can be lightened, and that the EDS detector can be cooled continuously over a long period and therefore maintained at a constant extremely low temperature. In consequence, it is allowable to continue the measurement with the electron microscope for a long time with high accuracy.

On the other hand, since another device for preventing evaporation of liquefied gas according to the invention has such an arrangement that a lead-in passageway for refrigerant gas is disposed so as to communicate with an opening at the top of a liquefied gas reservoir, the gas lead-in passageway having a gas supply control valve interposed therein, a cold head of a cryogenic refrigerator is disposed so as to fit an opening at the top of the liquefied gas reservoir and is braced to a frame with a linear guide mechanism interposed therebetween, the liquefied gas reservoir is braced to the cold head of the cryogenic refrigerator with vibration preventive means interposed therebetween, and the cold end of the cold head is plunged into the liquefied gas reservoir from the opening at the top thereof so as to allow the liquefied-gas liquid level within the liquefied gas reservoir to be detected by a level gauge. The gas supply control valve is controlled for opening and closing and moreover the cryogenic refrigerator is controlled for its automatic operation according to the the lower-limit liquid level detection actuation of the level gauge, when the liquid level in the liquefied gas reservoir is lowered below a certain level, refrigerant gas of vapor state is automatically introduced into the liquefied gas reservoir and at the same time the cryogenic refrigerator is actuated to condense and reliquefy the introduced refrigerant gas, thus enabling the liquefied gas within the liquefied gas reservoir to be held constantly within a certain range. Accordingly, vaporized gas is no longer dissipated wastefully so that the cycle of refilling liquefied gas reservoir with liquefied gas can be prolonged thereby to lighten the work load of resupplying liquefied gas, the work of refilling liquefied gas can be automated to lighten the load imposed on an operator and, moreover, the EDS detector can be cooled continuously over a long period, allowing the semiconductor to be held at a constant extremely low temperature, with the result that the electron microscope allows the measurement to be continued for a long time with high accuracy.

Still more, since the cryogenic refrigerator is operation-controlled by detecting the temperature or liquid level within the liquefied gas reservoir, the cryogenic refrigerator can be operated without being involved in wasteful, i.e., continuous operation.

Further, since the cold head of the cryogenic refrigerator is braced to prevent vibrations in the liquefied gas reservoir, even when the cryogenic refrigerator is operating, the vibration due to the operation of the cryogenic refrigerator is prevented from being transmitted to the liquefied gas reservoir, thus eliminating various adverse effects that would occur from the vibration of the liquefied gas liquid level.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENTS OF THE INVENTION

Figure 1:
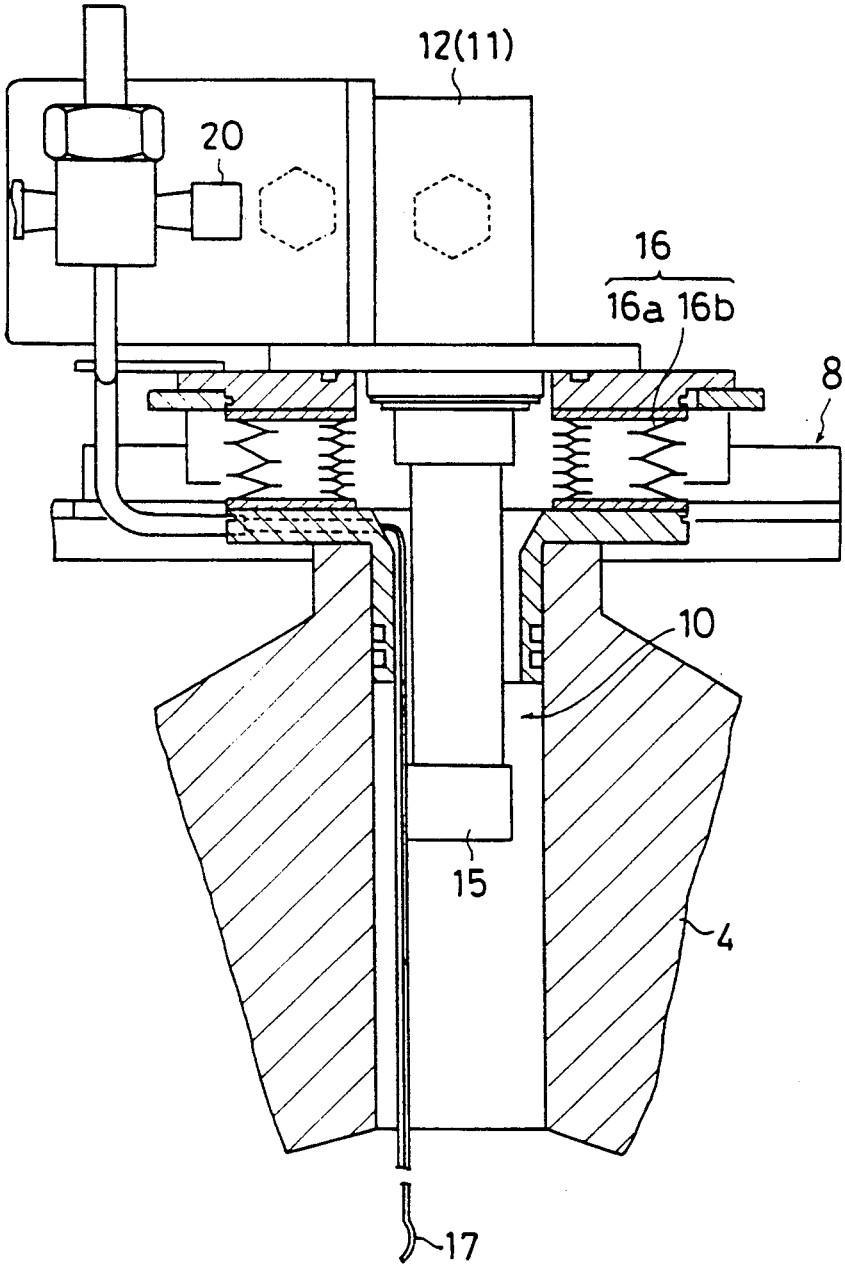
FIG. 1 is an enlarged sectional view of the main portion of the present invention.
Figure 2:
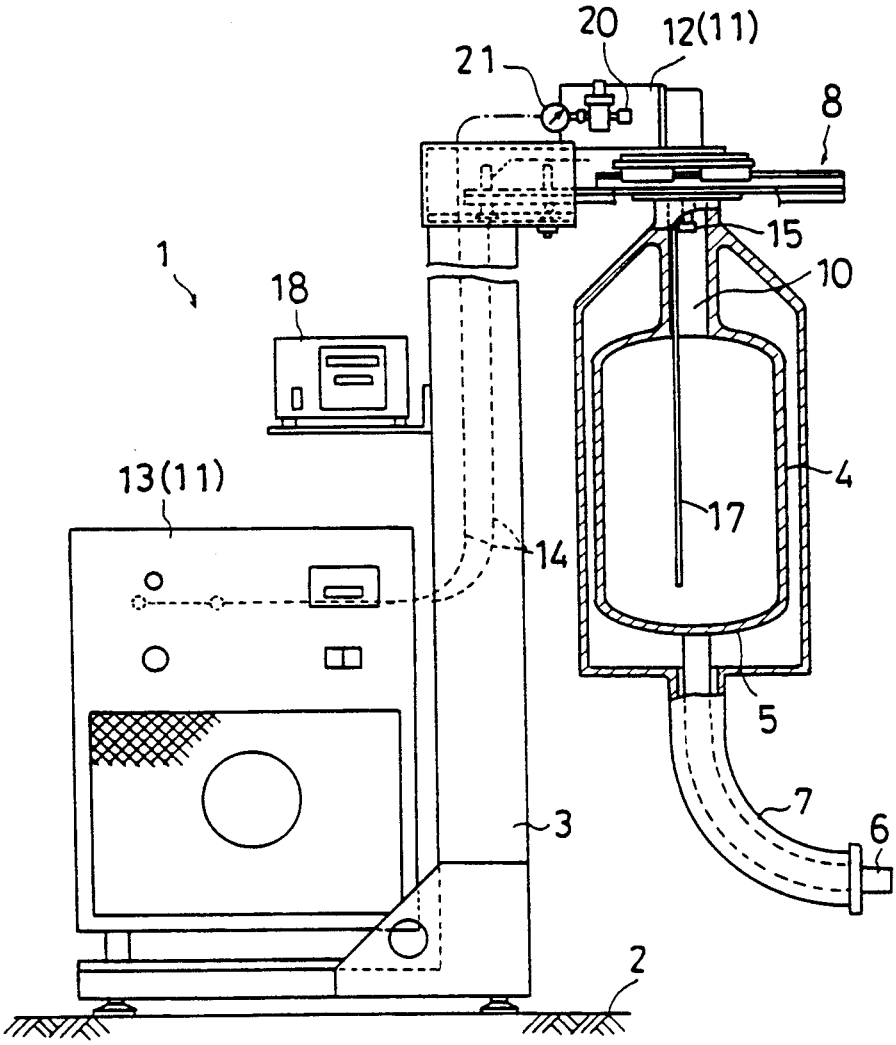
FIG. 2 is a side view of a low-temperature generator.
Figure 3:
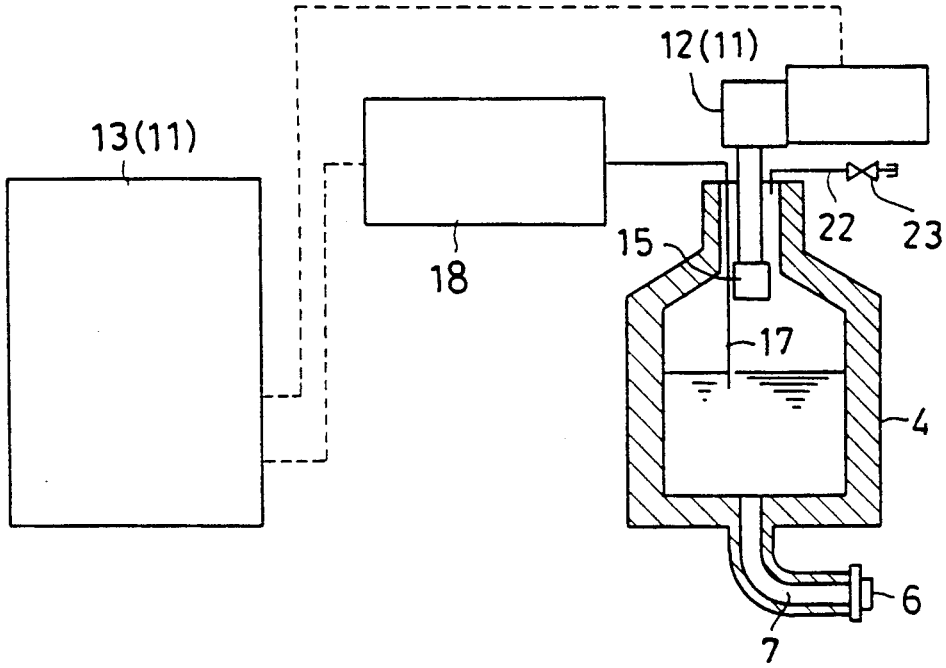
FIG. 3 is a conceptual view of the same.

A low-temperature generator 1 is composed of a liquefied gas reservoir 4 which has a cold finger 7 coupled with and drawn from its bottom wall 5 supporting a semiconductor sensor 6 which may comprise an EDS detector (energy dispersive spectrometer type x-ray detector), in an instrument such as a scanning type electron microscope, and a cryogenic refrigerator 11 disposed on the upper side of the liquefied gas reservoir 4. The liquefied gas reservoir 4 is formed of a heat-insulating vessel and has refrigerant comprising liquefied gas stored therein such as liquid nitrogen.

The cryogenic refrigerator 11 is composed of a cold head 12 and a compressor unit 13, the cold head 12 being braced to the upper end of a frame 3, erected from the floor 2, so as to fit an opening 10 at the top of the liquefied gas reservoir 4, the compressor unit 13 being braced to the floor 2 in a vibration-proof condition. The compressor unit 13 and the cold head 12 communicate with each other with the aid of two flexible tubes 14, wherein gas refrigerant such as helium, compressed by the compressor unit 13, is adiabatically expanded within the cold head 12 so that a cryogenic temperature can be obtained.

A cold end 15 of the cold head 12 is plunged or inserted into the above-mentioned liquefied gas reservoir 4 from the opening 10 at the top thereof, so that refrigerant liquefied gas, vaporized within the liquefied gas reservoir 4, is condensed and reliquefied through the cooling that takes place at the cold end 15.

Furthermore, bellows 16 are disposed between the cold head 12 and the liquefied gas reservoir 4 the bellows 16 function as a vibration preventive support means so as to prevent vibration accompanying the operation of the cryogenic refrigerator 11 from being transmitted to the liquefied gas reservoir 4. These bellows are of double bellows with an airtight chamber formed between inner bellows **16*a* and outer bellows 16*b*, the airtight chamber being held at atmospheric pressure. When the pressure within the liquefied gas reservoir 4 becomes negative due to the operation of the cryogenic refrigerator 11, although the bellows 16 attempt to shrink, since the intermediate sealed chamber is sealed, the atmospheric pressure in the chamber creates a resistance against the shrinking actuation, thus suppressing the upward movement of the liquefied gas reservoir 4. On the other hand, when the pressure within the liquefied gas reservoir 4 increases to a positive one due to a suspension of the operation of the cryogenic refrigerator 11, although the bellows 16 attempt to expand, the atmospheric pressure of the air in the intermediate sealed chamber resistance against the expansion actuation, thus suppressing the downward movement of the liquefied gas reservoir 4**.

In addition, in order for the liquefied gas reservoir 4 to move along with the retraction of the EDS detector, the cold head 12 is braced to frame 3 through a linear guide mechanism 8 so as to be movable horizontally in back and forth directions (i.e. right and left directions in the upper part of the figure).

The cryogenic refrigerator 11 is adapted to be automatically operated according to the temperature within the liquefied gas reservoir 4. More specifically, the cryogenic refrigerator 11 is so arranged that the ambient-atmosphere temperature and liquid temperature are detected by a temperature measuring instrument 17 such as a thermocouple or vapor-pressure thermometer, and then a detected-temperature signal according to the detected temperature detected by the temperature measuring instrument 17 is fed to the compressor unit 13 of the cryogenic refrigerator 11 through a temperature indicator 18 so as to start the operation of the cryogenic refrigerator 11 when the temperature within the liquefied gas reservoir reaches a predetermined high temperature and, in turn, to stop the operation when the in-reservoir temperature reaches a predetermined low temperature.

These reference values for the operation control, in the case of liquid nitrogen, are set to 72K for the high temperature and 70K for the low, for example. The set value of the high temperature, in this case, is derived from the fact that, since even slight vibration is undesirable during the work with the EDS detector therefore the automatic operation function of the cryogenic refrigerator 11 is suspended to perform the detection operation under the condition of no-operation of the cryogenic refrigerator 11, a high reference temperature 72K is given that takes more than about 8 hours to get liquid nitrogen to reach the boiling temperature of 77.34K under the condition of atmospheric pressure without operation of the cryogenic refrigerator 11.

In the figures, the reference numeral 20 denotes a safety valve which prevents gas pressure within the liquefied gas reservoir 4 from increasing above a predetermined pressure; 21 denotes a pressure gauge which indicates the pressure within the liquefied gas reservoir 4; 22 denotes a gas lead-in passageway for refilling the liquefied gas reservoir 4 with refrigerant gas of vapor state; and 23 a gas supply control valve interposed in the gas lead-in passageway 22.

Incidentally, the temperature measuring instrument 17 in the above-mentioned embodiment may be substituted by a level gauge so that the gas supply control valve will be controlled for opening and closing according to a liquid level detection signal from the level gauge and also the cryogenic refrigerator 11 will be controlled for its operation according to the same. In this case, when the liquid level within the liquefied gas reservoir 4 is decreased to a predetermined low level, the gas supply control valve 23 is opened to introduce refrigerant gas of a vapor state into the liquefied gas reservoir 4 while the cryogenic refrigerator 11 is put into operation. Then, the refrigerant gas of vapor state introduced therein is condensed by virtue of the cooling taking place at the cold end 15 of the cryogenic refrigerator 11; thus being liquefied. Conversely, when the liquid level in the liquefied gas reservoir 4 is increased up to a predetermined high level, the gas supply control valve 23 is closed while operation of the cryogenic refrigerator 11 is stopped Although each of the embodiments mentioned above uses the bellows 16 as vibration preventive means, it may also be arranged that the cold head 12 is braced from vibration by the counter-balance method or that some cushioning material such as a vibration preventive rubber can be fitted between the cold head 12 and the liquefied gas reservoir 4 to render vibration preventive support thereof.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

We claim:

1. In a liquefied gas reservoir in which a cold finger is coupled with and drawn from a wall thereof and an EDS detector (Energy Dispersive Spectrometer type X-ray detector) is secured thereto, a device for preventing evaporation of liquefied gas for use with said liquefied gas reservoir comprising:

a cold head of a cryogenic refrigerator is disposed so as to fit an opening formed in the top of a liquefied gas reservoir, said cold head being braced to a frame with a linear guide mechanism interposed therebetween which allows said cold head to move horizontally with respect to said frame, said liquefied gas reservoir being braced to said cold head with vibration preventive means interposed therebetween which damps vertical vibration, and said cold end of said cold head being inserted into said liquefied gas reservoir from said opening so that the temperature within said liquefied gas reservoir can be detected by a temperature measuring instrument, whereby said cryogenic refrigerator is controlled for the automatic operation thereof according to a temperature within said liquefied gas reservoir detected by said temperature measuring instrument.

2. A device for preventing evaporation of liquefied gas as claimed in claim 1, wherein said vibration preventive means comprises bellows.

3. The device for preventing evaporation of liquid gas as claimed in claim 2, wherein said bellows comprise inner and outer bellows having an air-tight chamber formed therebetween.

4. A device for preventing evaporation of liquefied gas as claimed in claim 1, wherein the automatic control of said cryogenic refrigerator is released according to a starting operation of a detection actuation of said EDS detector, whereas the automatic control of said cryogenic refrigerator is started according to a terminating operation of the detection actuation of said EDS detector.

5. In a liquefied gas reservoir in which a cold finger is coupled with and drawn from a wall thereof and an EDS detector (Energy Dispersive Spectrometer type X-ray detector) is secured thereto, a device for preventing evaporation of liquefied gas for use with said liquefied gas reservoir comprises:

a refrigerant gas lead-in passageway is disposed so as to communicate with an opening formed in the top of a liquefied gas reservoir, said gas lead-in passageway having a gas supply control valve interposed therein, and a cold head of a cryogenic refrigerator being disposed so as to fit said opening formed in the top of said liquefied gas reservoir, said cold head being braced to a frame with a linear travel guide mechanism interposed therebetween which allows horizontal movement of said cold head with respect to said frame, said liquefied gas reservoir being braced to said cold head with vibration preventive means interposed therebetween which damps vertical vibrations, and said cold end of said cold head is inserted into said liquefied gas reservoir from said opening at the top thereof so that the liquid level of liquefied gas within said liquefied gas reservoir can be detected by a level gauge, whereby said gas supply control valve is controlled for opening and closing thereof according to the lower-limit liquid level detection actuation by the level gauge while said cryogenic refrigerator is controlled for the automatic operation thereof.

6. A device for preventing evaporation of liquefied gas as claimed in claim 5, wherein said vibration preventive means comprises bellows.

7. The device for preventing evaporation of liquid gas as claimed in claim 6, wherein said bellows comprise inner and outer bellows having an air-tight chamber formed therebetween.

8. A device for preventing evaporation of liquefied gas as claimed in claim 5, wherein the automatic operation of said cryogenic refrigerator is released according to the starting operation of a detection actuation of said EDS detector, and the automatic operation of said cryogenic refrigerator is started according to the terminating operation of the detection actuation of said EDS detector.

9. An apparatus comprising:

(A) a liquid gas reservoir having an outer wall having an opening formed in a top portion thereof;

(B) a cold finger coupled to and extending through said outer wall of said reservoir;

(C) an energy dispersive spectrometer type X-ray detector coupled to said outer wall of said reservoir; and (D) a device for preventing the evaporation of liquid gas from said reservoir, said device including (a) a frame (b) a cryogenic refrigerator having a cold head inserted into said opening of said reservoir, (c) a linear guide mechanism which is connected to said frame and onto which is mounted said cold head, said linear guide mechanism permitting horizontal movement of said cold head relative to said frame, and (d) a vibration preventing device which connects said reservoir to said cold head and which damps vertical vibrations of said cold head.

10. The apparatus as claimed in claim 9, wherein said evaporation preventing device further comprises a temperature measuring instrument which measures the temperature of liquefied gas within said reservoir, and a control device which is responsive to said temperature measuring instrument and which regulates the temperature of said liquified gas via automatic actuation of said cryogenic refrigerator.

11. The apparatus as claimed in claim 9, wherein said vibration damping device comprises bellows.

12. The apparatus as claimed in claim 11, wherein said bellows comprise inner and outer bellows having an air-tight chamber formed therebetween.

13. A method for preventing evaporation of liquid gas from a liquid gas reservoir having an outer wall having an opening formed in a top portion thereof, said reservoir having a cold finger coupled to and extending through said outer wall and an energy dispersive spectrometer type X-ray detector coupled to said outer wall, said method comprising:

(A) horizontally moving a cold head of a cryogenic refrigerator on a linear guide mechanism relative to a frame, said linear guide mechanism being mounted on said frame, said cold head being inserted into said opening of said reservoir;

(B) measuring the temperature of said liquid gas in said reservoir via a temperature measuring instrument;

(C) regulating the temperature of said liquid gas in said reservoir by actuating said cryogenic refrigerator in response to measurements taken by said temperature measuring instrument; and (D) damping vertical vibrations of said cold head caused by pressure variations resulting from temperature variations in said reservoir.

14. The method as claimed in claim 13, wherein said damping step is performed via movement of bellows.

15. The method as claimed in claim 13, wherein said damping step is performed via movement of bellows comprising inner and outer bellows having an air-tight chamber formed therebetween.

16. The method as claimed in claim 13, further comprising the steps of terminating said automatic operation of said cryogenic refrigerator upon activation of said energy dispersive spectrometer type X-ray detector and initiating said automatic operation of said cryogenic refrigerator upon deactivation of said energy dispersive spectrometer type X-ray detector.

* * * * *